US006318562B1

(12) United States Patent
Wilkie et al.

(10) Patent No.: US 6,318,562 B1
(45) **Date of Patent: *Nov. 20, 2001**

(54) FILTERING CENTRIFUGE WITH CAKE HEEL REMOVAL MECHANISM

(75) Inventors: William John Wilkie, Escondido; James F. Kleyn, Santee, both of CA (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/368,123

(22) Filed: Aug. 4, 1999

Related U.S. Application Data

(63) Continuation-in-part of application No. 09/112,676, filed on Jul. 9, 1998, now Pat. No. 6,063,298.

(51) Int. Cl.[7] ..... B04B 3/00

(52) U.S. Cl. ..... 210/355; 210/370; 210/391

(58) Field of Search ..... 210/355, 369, 210/370, 384, 391, 392, 394, 402, 403, 407, 784, 787, 791, 796

(56) References Cited

U.S. PATENT DOCUMENTS

| | | |
|---|---|---|
| 3,608,721 | 9/1971 | Lopker . |
| 3,703,983 | 11/1972 | Tholl . |
| 3,983,036 | 9/1976 | Lauzeral et al. . |
| 4,008,158 | 2/1977 | Davis . |
| 4,017,399 | 4/1977 | Lopker . |
| 4,081,381 | 3/1978 | Rosenmund et al. . |
| 4,113,000 | 9/1978 | Poisson . |
| 4,131,548 | 12/1978 | Peterson . |
| 4,142,971 | 3/1979 | Le Fur et al. . |
| 4,153,550 | 5/1979 | Lautrette . |
| 4,377,479 | 3/1983 | Pierson . |
| 4,377,480 | 3/1983 | Pierson . |
| 4,707,260 | 11/1987 | Nagayama et al. . |
| 5,202,034 | 4/1993 | Martel, Jr. . |
| 5,547,573 * | 8/1996 | Martin . |
| 5,618,424 | 4/1997 | Nagaoka . |
| 5,622,625 | 4/1997 | Nagaoka . |

FOREIGN PATENT DOCUMENTS

| | | |
|---|---|---|
| 686232 A5 | 2/1996 | (CH) . |
| 8533546 | 4/1986 | (DE) . |
| 4231820 A1 | 4/1993 | (DE) . |
| 01-085150 | 3/1989 | (JP) . |

* cited by examiner

*Primary Examiner*—W. L. Walker
*Assistant Examiner*—David Sorkin
(74) *Attorney, Agent, or Firm*—R. Neil Sudol; Henry D. Coleman; William J. Sapone

(57) ABSTRACT

A filtering centrifuge includes a case, a perforated filter basket disposed for rotation in the case, filter media disposed along an inner surface of the filter basket, and a cake removal mechanism at least partially disposed in the case outside of the filter basket and engageable with the filter media to distort the filter media and induce separation of deposited cake from the filter media. The cake removal mechanism specifically includes an ejector element movably mounted to the case for shifting between a use position adjacent to the filter basket and a neutral position spaced from the filter basket.

9 Claims, 4 Drawing Sheets

FILTERING CENTRIFUGE WITH CAKE HEEL REMOVAL MECHANISM

CROSS-REFERENCE TO RELATED APPLICATION

This application is a continuation-in-part of application Ser. No. 09/112,676 filed Jul. 9, 1998, now U.S. Pat. No. 6,063,298.

BACKGROUND OF THE INVENTION

This invention relates to a filtering centrifuge. More specifically, this invention relates to a filtering centrifuge with a mechanism for removing cake from filter media disposed along the inner surface of a rotatable filter basket. This invention also relates to an associated method for cleaning a filtering type centrifuge of cake deposited along filter media in the centrifuge.

A filtering centrifuge generally comprises a rotating perforated drum commonly referred to as a basket. This basket is lined with pervious filter media. During operation of the centrifuge, the basket is rotated while a slurry of solids suspended in a liquid is introduced into the basket. The rotation of the basket generates a multiplied centrifugal force which flings the slurry outwardly onto the filter media. The solids portion of the slurry is captured by the filter media and is deposited as a cake layer thereon, while the liquid portion of the slurry drains through the filter media and out of the basket through the perforations therein.

Once the processing of the captured solids is complete, in many cases the solids are automatically discharged by introducing a deflector blade or plow into the captured solids (filter cake) as the basket slowly rotates. The cake is thereby deflected out through an opening in the bottom of the basket. In executing this operation, the plow is stopped short of contacting the filter media to prevent damage thereto. This procedure results in a thin layer of undischarged cake being left in the basket. This undischarged layer of cake is referred to as "heel."

SUMMARY OF THE INVENTION

The present invention is directed to providing a structure and a process for removing heel from the basket of a filtering centrifuge without damaging the filter media. The present invention is intended to provide a simple and inexpensive structure for achieving this end. A process or method for cleaning a filtering centrifuge in accordance with the present invention has an aim of being quick and reliable, as well as preservative of the filter media.

A centrifuge in accordance with the present invention comprises a case, a perforated filter basket disposed for rotation in the case, filter media disposed along an inner surface of the filter basket and a cake removal mechanism at least partially disposed in the case outside of the filter basket and engageable with the filter media to distort the filter media and induce separation of deposited cake from the filter media. The cake removal mechanism specifically includes an ejector element movably mounted to the case for shifting between a use position adjacent to the filter basket and a neutral position spaced from the filter basket.

More specifically, the cake removal mechanism includes a nozzle assembly having a base element fixed to said case and a sleeve movably mounted about a core portion of said base element for shifting between a use position adjacent to the filter basket and a neutral position spaced from the filter basket.

In accordance with another feature of the present invention, the core portion of the nozzle assembly base is provided with a bore or channel for directing a pressurized fluid through the filter basket and against the filter media. The base element is provided with an additional bore, surrounding and generally coaxial with the core bore, the sleeve being slidably disposed in that additional bore. The sleeve is thus sandwiched, in a telescoping fashion between the core portion of the base and an outer portion of the base.

In accordance with further features of the present invention, the sleeve is provided with a flange disposed in the additional bore and defines an enlarged recess at a free end of the core portion. The flange provides an increased surface area for exerting pressure against the sleeve to shift the sleeve radially inwardly towards the filter basket, while the enlarged recess increases the time interval that the filter media experiences an inward pressure owing to fluid (e.g., air) ejected from a radially inner end of the nozzle assembly through perforations in the filter basket.

A method for use in automatic cleaning of a filtering centrifuge comprises, in accordance with the invention, providing a centrifuge having a perforated filter basket in a case, a filter media being disposed along an inner surface of the filter basket. The method further comprises providing a nozzle assembly having a base element and an ejector element movably mounted to the base element for shifting between a use position adjacent to the filter basket and a neutral position spaced from the filter basket. Pursuant to the method, the base element is fixed to the case so that the ejector element extends in a radial direction relative to the filter basket and so that the ejector element is spaced from the filter basket.

The method further comprises shifting the ejector element radially inwardly towards the filter basket during a rotating of the filter basket. The base element is connected to a source of pressurized fluid, so that the shifting of the ejector element is achieved by directing pressurized fluid from the source against the ejector element to force the ejector element in a radially inward direction. Fluid is directed through the ejector element and perforations in the filter basket upon the shifting of the ejector element radially inwardly. By virtue of the directing of fluid through the ejector element and the filter basket, a radial force is exerted against the filter media through the perforations during the rotation of the basket in the case. By virtue of the force exerted on the filter media through the perforations, the filter media is distorted to induce separation of deposited cake from the filter media.

The method further includes holding the ejector element in sliding contact with an outer surface of the filter basket while the filter basket rotates.

DESCRIPTION OF THE PREFERRED EMBODIMENTS

Figure 1:
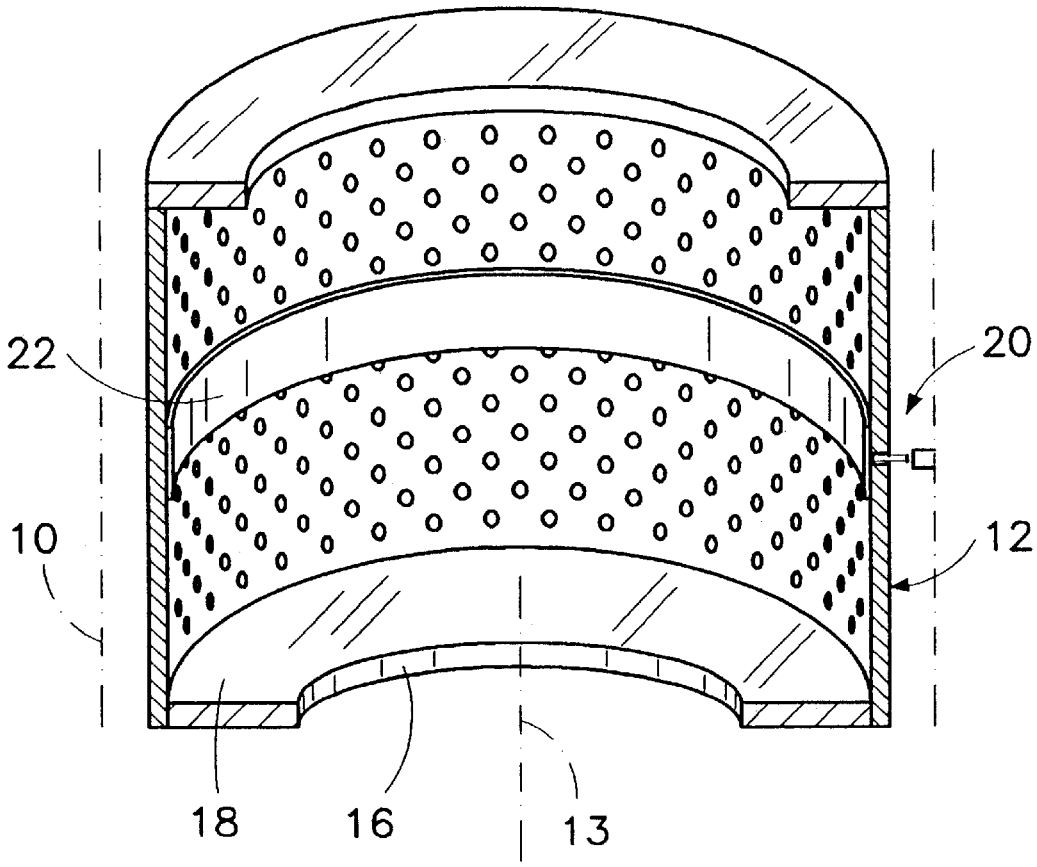
FIG. 1 is a schematic longitudinal cross-sectional view of a filtering centrifuge basket provided with a circumferentially extending flexible strap in accordance with the present invention.

As illustrated in FIG. 1, a filtering centrifuge comprises a tank or case 10 and a perforated cylindrical filter basket 12 disposed in case 10 for rotation about an axis 13. As shown in the detail views of FIGS. 2 and 3, filter media 14, typically a woven fabric, is disposed along an inner surface of filter basket 12. Pursuant to the prior art, in a first step of removing captured solids (filter cake) deposited on filter media 14, a deflector blade or plow (not shown) is inserted into filter basket 12 as the basket slowly rotates. The deflector blade or plow separates a layer of cake from the total cake deposited on filter media 14. The separated cake drops out through an opening 16 in a bottom panel 18 of basket 12. In executing this operation, the leading edge of the plow is spaced from filter media 14 to prevent damage thereto.

As illustrated in FIGS. 1–4, an ancillary cake removal mechanism 20 is at least partially disposed in case 10 outside of filter basket 12 for removing residual cake or heel left on filter media 14 after the use of the deflector blade or plow to separate an innermost layer of cake from the filter media. Cake removal mechanism 20 includes a circumferentially extending strap or band 22 which is disposed along the inner surface of filter basket 12. Strap 22 carries a plurality of outwardly extending pins 24 which traverse respective perforations or bores 26 formed in a cylindrical side wall 28 of basket 12.

Figure 2:
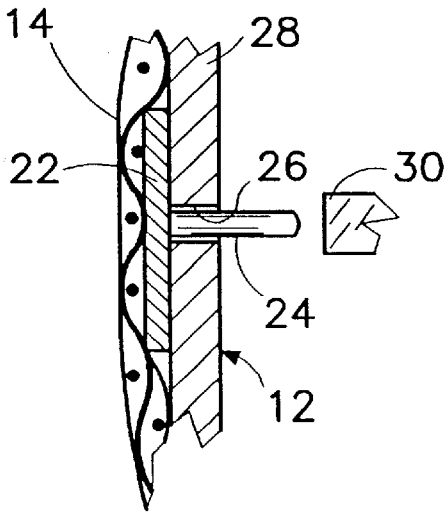
FIG. 2 is a schematic partial cross-sectional view, on an enlarged scale, of a portion of the basket of FIG. 1, showing the strap.
Figure 3:
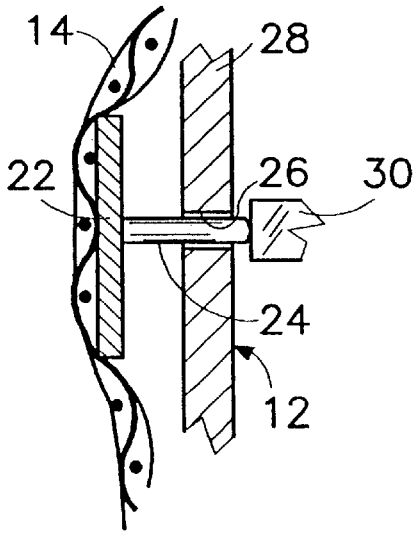
FIG. 3 is a schematic partial cross-sectional view, similar to FIG. 2, showing action of a retractable pawl on the strap.

Cake removal mechanism 20 further includes an ejector element 30 which is movably mounted to case 10 for shifting from a neutral or non-operative position illustrated in FIGS. 1 and 2 to a use or operative position illustrated in FIG. 3. The neutral or non-operative position is assumed by ejector element 30 during filtering operations, while the use or operative position is assumed during a cleaning operation. As filter basket 12 rotates slowly during a heel removal operation, ejector element 30 contacts one pin 24 after another to distort strap 22 in a simulated wave motion (see reference designation 36 in FIG. 4), concomitantly distorting filter media 14 and inducing separation of deposited cake from filter media 14. Thus, cake removal mechanism 20 particularly including strap 22 is engageable with filter media 14 to temporarily deform the filter media for purposes of cake removal.

It is to be noted that circumferentially extending strap 22 is one of a multiplicity of different strap configurations and combinations utilizable for generating a temporary deformation in filter media 14. For example, strap 22 might be replaced by a plurality of circumferentially spaced, axially extending straps (not illustrated). Each such strap might be provided with a single pin projecting radially outwardly through a respective perforation 26 in basket 12, the pins being disposed in a common transverse plane for engagement by ejector element 30 during a heel removal procedure.

Ejector element 30 is radially shiftable by any means, many of which are well known in the art. For example, the shifting of ejector element 30 may be implemented hydraulically, pneumatically, electromagnetically or simply mechanically by a manual operation.

Figure 4:
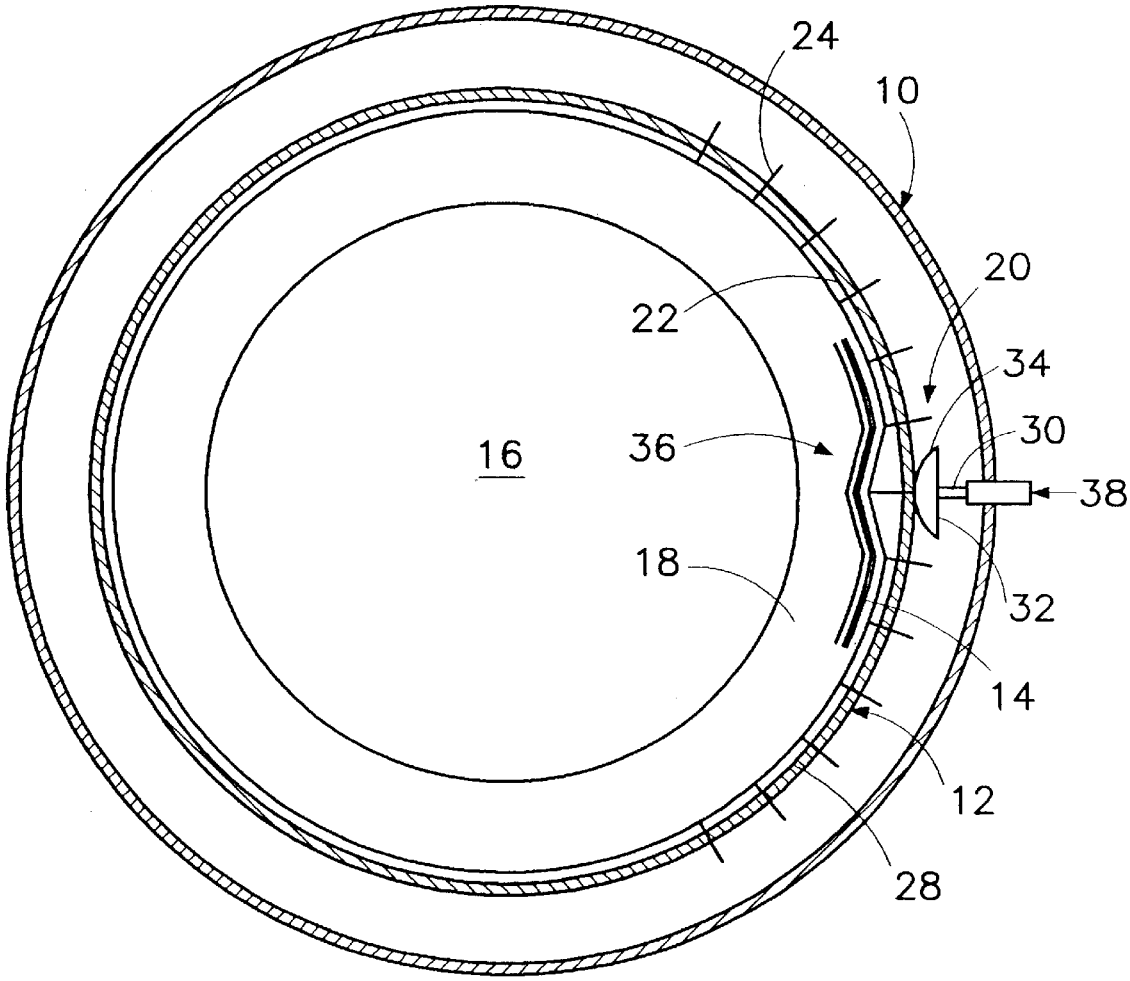
FIG. 4 is a schematic top plan view of the filtering basket of FIG. 1, depicting distortion of a filter media web in accordance with the present invention.

As illustrated in FIG. 4, ejector element 30 may take the form of a plunger provided at a free or inner end with a head 32 having a camming surface 34 facing filter basket 12. Camming surface 34 engages pins 24 to push strap 22 and concomitantly filter media 14 in a radially inward direction during a heel removal procedure or basket cleaning operation. Ejector element or plunger 30 is shiftably mounted to a base 38 in turn fastened to case 10.

Figure 5:
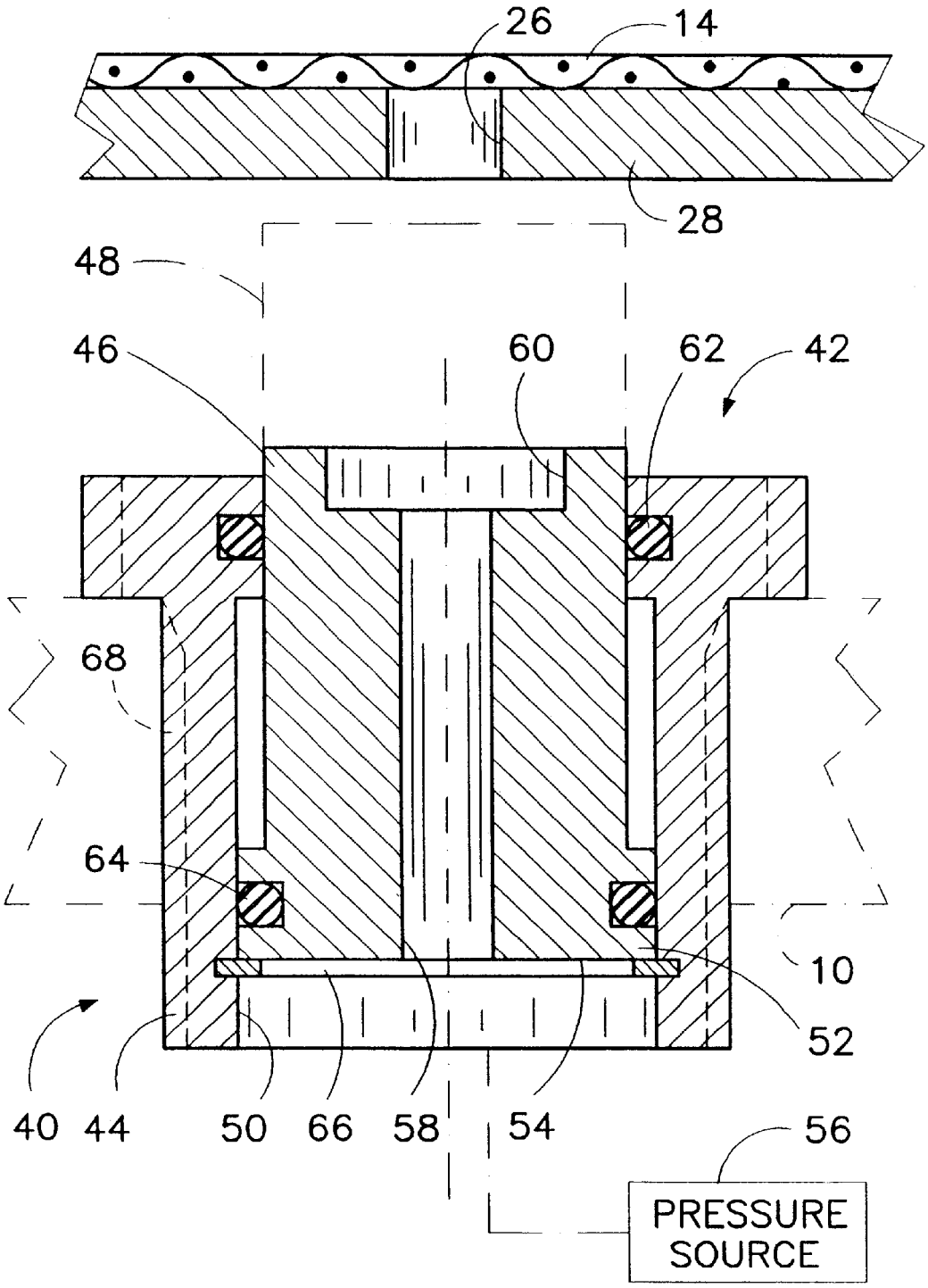
FIG. 5 is a schematic cross-sectional view of an ejector nozzle used to distort a filter web, in accordance with the present invention.

As illustrated in FIG. 5, an ancillary or alternative cake removal mechanism 40 incorporates a nozzle assembly 42 having a base element or holder 44 fixed to case 10. The nozzle assembly also has a generally cylindrical ejector element 46 movably mounted to base element 44 for shifting between a use position (phantom lines) 48 adjacent to filter basket 12 and a neutral position (solid lines) spaced from filter basket 12. Base element 44 is provided with a bore 50, ejector element 46 being slidably disposed in the bore. Base element 44 and ejector element 46 are made of any suitable material, for example, a metal or a polymeric substance such as polytetrafluoroethylene.

Ejector element 46 is provided with a circumferentially extending flange 52 disposed in bore 50. This flange 52 may serve as a stop or arrest to limit extension of ejector element 46. Flange 52 also serves to provide a pressure surface 54 for enabling a shifting of ejector element 46 in a radially inward direction upon the application of pressurized fluid from a pressure source 56 to flange 52. The pressurized fluid, e.g., gas, is delivered to nozzle assembly 42 also with the purpose of generating a jet of gas which passes through a bore 58 in ejector element 46 and emanates from nozzle assembly 42 against filter basket 12. The jet of gas (e.g., air) traverses passageways or perforations 26 in filter basket 12 to engage filter media 14 and exert an inward force thereon, thereby billowing the filter media to dislodge heel or cake deposited thereon. If basket 12 is rotating, the distortion in filter media 14 proceeds in a wave-like fashion along a circumference of the basket. Generally, ejector element 46 rides along an outer surface of basket 12 during the heel removal operation Bore 58 includes an enlarged recess 60 at a free end of ejector element 46 for increasing the time that air or gas is fed through each successive or adjacent perforation 26 in a transverse plane (not shown or designated) through basket 12.

Nozzle assembly 42 may be provided with a compression or restoring spring (not illustrated) for returning ejector element 46 from the extended use position 48 to the retracted neutral position upon cessation of pressure from source 56. Alternatively, pressure source 56 may be provided with a suction capability for pulling ejector element 46 back into bore 50 upon the completion of a cake removal operation.

Generally, it is contemplated that a series of nozzle assemblies 42 are held in a manifold mounted to case 10. The plural nozzle assemblies are disposed in a linear array parallel to the rotation axis of the centrifuge. Polytetrafluoroethylene 0-rings 62 and 64 are provided for sealing purposes, while a retainer ring 66 limits the motion of ejector element 46 in an outward direction. An external screw thread 68 on base element 44 cooperates with an internal screw thread (not separately designated) on case 10 or the manifold to fasten nozzle assembly 42 to the case or the manifold.

Figure 7:
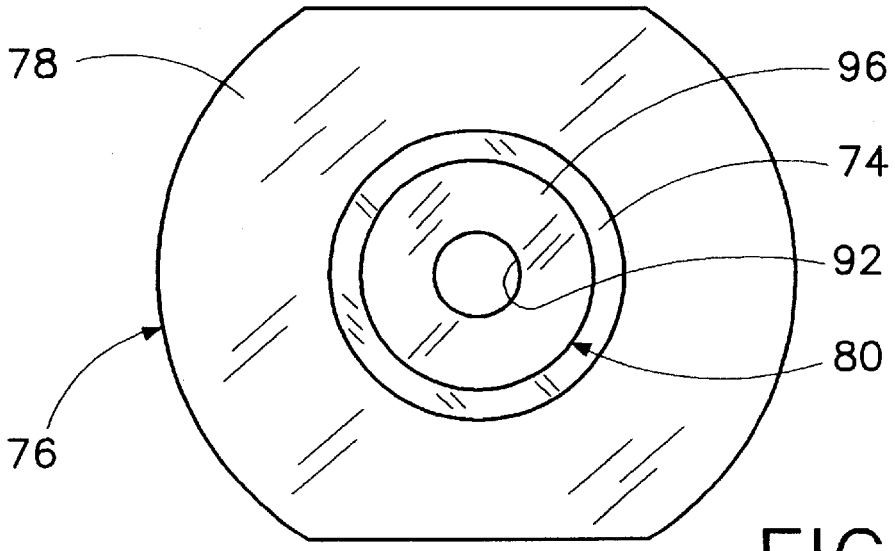
FIG. 7 is a top plan view of the nozzle of FIG. 6.
Figure 6:
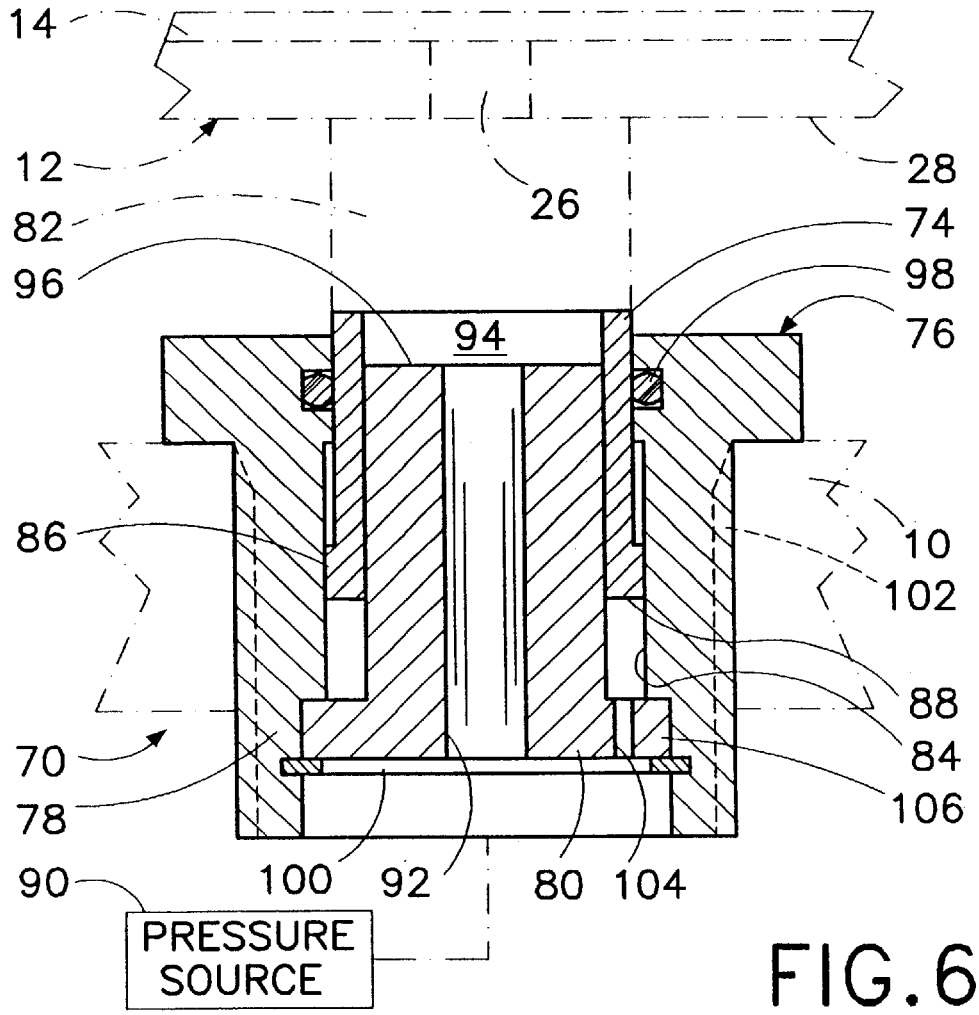
FIG. 6 is a schematic cross-sectional view of another ejector nozzle, similar to that of FIG. 5, used to distort a filter web, in accordance with the present invention.

As depicted in FIGS. 6 and 7, a modified nozzle assembly 70 for removing cake from filter media 14 disposed along an inner surface of filter basket 12 has a base or holder 76 fixed to case 10. Nozzle assembly 70 comprises a movable ejector element 74 in the form of a sleeve slidably mounted to base 76 for selectively guiding pressurized fluid against basket wall 28. Base 76 includes an outer element or collar 78 and an inner element or core 80 fixedly secured to one another.

Ejector element 74 is slidably mounted in a bore 84 of collar 78 and telescopingly mounted to core 80 of base 76 for shifting between a use position 82 (phantom lines) adjacent to and in sliding contact with filter basket 12 and a neutral position (solid lines) spaced from filter basket 12. Base 76 and ejector element 74 are made of any suitable material, for example, a metal or a polymeric substance such as polytetrafluoroethylene.

Ejector element 74 is provided with a circumferentially extending flange 86 disposed in bore 84. This flange 86 may serve as a stop or arrest to limit extension of ejector element 74. This flange 86 also serves to provide a pressure surface 88 for enabling a shifting of ejector element 74 in a radially inward direction relative to case 10 upon the application of pressurized fluid from a pressure source 90 to flange 86 through a passageway 104 in a flange 106 of core 80. The pressurized fluid, e.g., gas, is delivered to nozzle assembly 70 also with the purpose of generating a jet of gas which passes through a bore 92 in core 80 and emanates from nozzle assembly 70 against filter basket 12. The jet of gas (e.g., air) traverses passageways or perforations 26 in filter basket 12 to engage filter media 14 and exert an inward force thereon, thereby billowing the filter media to dislodge heel or cake deposited thereon. Again, if basket 12 is rotating, the distortion in filter media 14 proceeds in a wave-like fashion along a circumference of the basket. Generally, ejector element 46 slides or rides along an outer surface of basket 12 during the heel removal operation.

Bore 92 communicates with an enlarged recess 94 defined by an end portion (not designated) of ejector element 74 and by a transverse end surface 96 of core 80. Recess 94 functions to increase the time that air or gas is fed through each successive or adjacent perforation 26 in a transverse plane (not shown or designated) through basket 12.

Nozzle assembly 70 may be provided with a compression or restoring spring (not illustrated) for returning ejector element 74 from the extended use position 82 to the retracted neutral position upon cessation of pressure from source 90. Alternatively, pressure source 90 may be provided with a suction capability for pulling ejector element 74 back into bore 84 upon the completion of a cake removal operation.

As discussed above with reference to FIG. 5, it is contemplated that a series of nozzle assemblies 70 are held in a manifold mounted to case 10. The plural nozzle assemblies are disposed in a linear array parallel to the rotation axis of the centrifuge. A polytetrafluoroethylene O-ring 98 is provided for sealing purposes, while a retainer ring 100 limits the motion of ejector element 74 in an outward direction. An external screw thread 102 on outer base element or collar 78 cooperates with an internal screw thread (not separately designated) on case 10 or the manifold to fasten nozzle assembly 70 to the case or the manifold.

Relative to the embodiment of FIG. 5, the embodiment of FIGS. 6 and 7 reduces the amount of force that is exerted by the cake removal mechanism on filter basket 12. This reduction in force decreases the drag on the rotating basket.

Although the invention has been described in terms of particular embodiments and applications, one of ordinary skill in the art, in light of this teaching, can generate additional embodiments and modifications without departing from the spirit of or exceeding the scope of tie claimed invention. For example, a cake removal mechanism as disclosed herein may be used as an alternative to a conventional deflector blade or plow, as well as a supplement thereto. In addition, the embodiment of FIG. 5 or of FIGS. 6 and 7 may be used as an alternative or a supplement to the embodiment of FIGS. 1–4. It is to be noted further that ejector element 30 may take the form of a wheel rotatably mounted to a radially inner end of a radially shiftable plunger.

Accordingly, it is to be understood that the drawings and descriptions herein are offered by way of example to facilitate comprehension of the invention and should not be construed to limit the scope thereof.

What is claimed is:

1. A centrifuge comprising:

a case;

a perforated filter basket disposed in said case for rotation about an axis;

filter media disposed along an inner surface of said filter basket; and a cake removal mechanism at least partially disposed in said case outside of said filter basket and engageable with said filter media to distort said filter media and induce separation of deposited cake from said filter media, said cake removal mechanism including a nozzle assembly having a base element fixed to said case and a sleeve movably mounted about a core portion of said base element for shifting between a use position adjacent to said filter basket and a neutral position spaced from said filter basket.

2. The centrifuge defined in claim 1 wherein said core portion is provided with a bore or channel for directing a pressurized fluid through said filter basket and against said filter media.

3. The centrifuge defined in claim 2 wherein said base element is provided with an additional bore, said sleeve being slidably disposed in said additional bore.

4. The centrifuge defined in claim 3 wherein said sleeve is provided with a flange disposed in said additional bore.

5. The centrifuge defined in claim 4 wherein said sleeve defines an enlarged recess at a free end of said core portion.

6. The centrifuge defined in claim 5 wherein said sleeve is shiftable in a radial direction relative to said filter basket.

7. The centrifuge defined in claim 1 wherein said base element is provided with a bore, said sleeve being slidably disposed in said bore.

8. The centrifuge defined in claim 7 wherein said sleeve is provided with a flange disposed in said additional bore.

9. The centrifuge defined in claim 1 wherein said sleeve defines an enlarged recess at a free end of said core portion.

* * * * *